US006364375B1

(12) United States Patent
Szapucki et al.

(10) Patent No.: US 6,364,375 B1
(45) Date of Patent: Apr. 2, 2002

(54) APPARATUS FOR SECURING SASH WINDOW

(75) Inventors: Matthew Peter Szapucki, Toms River; Richard J. Kulkaski, Forked River, both of NJ (US)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 09/504,112

(22) Filed: Feb. 15, 2000

(51) Int. Cl.[7] ..... E05C 5/00

(52) U.S. Cl. ..... 292/63; 292/221; 292/338; 292/DIG. 47

(58) Field of Search ..... 292/63, 64, 67, 292/202, 203, 204, 221, 338, 339, DIG. 15, DIG. 20, DIG. 47

(56) References Cited

U.S. PATENT DOCUMENTS

| | | | | | |
|---|---|---|---|---|---|
| 126,872 | A | * | 5/1872 | Buckman | 292/DIG. 20 |
| 417,868 | A | * | 12/1889 | Janes | 292/67 |
| 534,185 | A | | 2/1895 | Winchester | |
| 804,994 | A | * | 11/1905 | Andrews | 292/DIG. 20 |
| 897,719 | A | * | 9/1908 | Daubaignan | 292/63 |
| 1,003,386 | A | * | 9/1911 | Welker | 292/DIG. 20 |
| 1,077,487 | A | | 11/1913 | Miller | |
| 1,173,129 | A | * | 2/1916 | Taliaferrro | 292/DIG. 20 |
| 1,190,519 | A | | 7/1916 | Creager et al. | |
| 1,656,818 | A | | 1/1928 | Dillon | |
| 1,724,637 | A | | 8/1929 | Bergstrom | |
| 2,610,849 | A | | 9/1952 | Young | |
| 3,015,511 | A | | 1/1962 | Sitterly | |
| 3,141,188 | A | * | 7/1964 | Gray | 292/DIG. 15 |
| 4,095,827 | A | | 6/1978 | Stavenau | |
| 4,274,666 | A | | 6/1981 | Peck | |
| 4,682,455 | A | | 7/1987 | Klompenburg | |
| 4,721,332 | A | | 1/1988 | Sturman | |
| 4,813,725 | A | | 3/1989 | Mosch | |
| 4,824,154 | A | | 4/1989 | Simpson | |
| 4,923,230 | A | | 5/1990 | Simpson | |
| 5,083,398 | A | | 1/1992 | Kolbeck et al. | |
| 5,110,165 | A | | 5/1992 | Piltingsrud | |
| 5,248,174 | A | | 9/1993 | Matz et al. | |
| 5,492,377 | A | | 2/1996 | Guelck | |
| 5,536,052 | A | | 7/1996 | Maier | |
| 5,553,903 | A | | 9/1996 | Prete et al. | |
| 5,582,445 | A | | 12/1996 | Olsen et al. | |
| 5,653,485 | A | | 8/1997 | Campbell | |
| 5,806,900 | A | | 9/1998 | Bratcher et al. | |

* cited by examiner

*Primary Examiner*—Christopher P. Schwartz
*Assistant Examiner*—Thomas J. Williams
(74) *Attorney, Agent, or Firm*—Wallenstein & Wagner, Ltd.

(57) ABSTRACT

A window securing device (36) for use in a double-hung sash window assembly having upper and lower sash window frames (14,16) installed for relative overlapping vertical sliding movement, said upper sash frame (14) having a recess into the interior of a vertical facial member of the window. The device (36) includes a housing (38) having a front faceplate opening (51) into a cavity (50) therein and a means for retaining the housing (38) in the recess with the faceplate (42) covering the edges of the recess. A pawl (40) mounted in the cavity (50) of the housing (38) is spring biased into an extended position where the lowermost arresting edge protrudes through the opening (51). In effect, the extended pawl (40) blocks the pathway of a top portion of the lower sash (16) for preventing further upward movement thereof. With the pawl (40) in the extended position, the uppermost contact edge (46) of said pawl (40) is configured for abutting against an inside edge (52) of the top of the opening (51) in said faceplate (42). A substantial portion of the upward force associated with the lifting of the lower sash (16) against the arresting edge is transferred into the upper sash frame for enhanced resistance.

23 Claims, 4 Drawing Sheets

APPARATUS FOR SECURING SASH WINDOW

DESCRIPTION

1. Technical Field

The present invention relates generally to a window stop, and more particularly to an improved window securing device for preventing or limiting movement of a window sash.

2. Background of the Invention

Double-hung windows are one of the most common kinds of windows for residential and other structures. Typically, a double-hung window assembly consists of a window frame and a pair of window sashes. The lower sash resides immediately inward of the upper sash so that the sashes overlap and vertically slide parallel to one another along guide rails of the master window jamb of the window assembly. Although window sashes are traditionally made exclusively of wood, such window sashes can be formed of extruded plastic frame members or metal frame members joined at the corners, for example, to form a generally rectangular frame in which the glazing is installed.

Most double-hung windows include a locking mechanism located at the point where the sashes meet when the window assembly is closed. A latch mechanism is fixed on the header of the lower sash and the corresponding latch-receiving mechanism is fixed on the sill of the other sash. When the window sashes are in the closed position, the lock may be secured to prevent any movement of the sashes. The problem associated with these locks is that they are typically difficult to secure either because of the tight tension of the mechanism or the need to align the lock with the latch perfectly before securing. Such locks also fail to provide the user an option to open the window slightly to allow ventilation, while also inhibiting egress in or out through the window.

To limit the relative movement of the sashes, stop or limit devices known as "sash locks" or "window stops" have been developed to solve the above problems. Sash locks in various designs and forms are now available. Typically, the designs include a pawl pivotally mounted in a housing in a stile member of the upper sash. A spring biases the pawl toward an extended position, whereby the pawl is configured to engage the header member of the lower sash to limit movement thereof. An upper rear surface of the pawl is engageable with a back wall of the housing in cooperation with a pivot post or lug to serve to limit rotation of the pawl.

Over-rotation of the pawl has been a problem with this type of sash lock. Occasionally, the lower sash or the user may engage the pawl in such a way that it does not properly engage the back wall of the housing. It has also been found that in applications where large forces are applied to prior art pawls, the back wall of the housing can deform under the increased horizontal force against the back wall imposed by the pawl, and allow the pawl to slide along the back wall and over-rotate, permitting the window to open. Tremendous stress is also exerted on the pivot post or lug that may also result in failure during engagement with the lower sash. In both incidents, over-rotation occurs and the stop fails to adequately limit movement of the lower sash.

Another problem encountered by prior art sash locks is the existence of a gap between the lower end of the pawl and housing when the pawl is extended. This gap allows dust and debris to collect within the cavity over time. Eventually the cavity of the housing becomes impacted with dirt, whereby the proper functioning of the sash lock is impeded. With respect to the manufacture of sash locks, typically, prior art sash lock housings are composed of two or more parts that require assembly. Sash locks incorporating such housings cost more to produce than if unitary housings were utilized.

Accordingly, there is a need for an improved window stop, wherein the stop is simple to manufacture, stronger and more durable, less prone to failure, and cost effective to produce.

SUMMARY OF THE INVENTION

The present invention is generally directed to a window securing device for use in a double-hung window assembly having upper and lower sash window frames installed for vertical reciprocal sliding movement relative to each other. The stile member of the upper sash has a recess on the front surface for installing the device into the recess.

The window securing device includes a housing that is configured to be securely retained in the recess provided in the stile of the upper sash so that the faceplate of the housing protrudes slightly ahead of the stile's surface. The faceplate has an opening that is continuous with an interior cavity of the housing.

A pawl is disposed in the cavity and is configured to move between a retracted position and an extended or securing position. In the securing position, an end of the pawl projects from the opening in the faceplate and is configured to engage an exterior surface of the header of the lower sash to prevent upward vertical movement thereof. The pawl is spring biased to a normally protruding securing position and is movable to a retracted position in the housing. A spring is mounted directly on the pawl via one end that engages the pawl, and the other end of the spring engages the back wall of the housing.

In the securing position, the pawl engages the lower sash frame and prevents further relative sliding movement of the sash frames. The pivotally mounted pawl is manually retractable into the cavity to disengage the lower end of the pawl from the lower sash frame header. The faceplate and the retaining studs are cooperatively engageable to releasably maintain the lower end of the pawl in the retracted position. When the pawl is retracted, relative sliding movement between the sash frames can occur.

In one embodiment of the present invention, the pawl includes a contact edge proximate to its upper end for preventing the pawl from overextending when the lower sash window is intercepted. It transfers and directs the vertical force originating from the sash window into the stile of the upper window sash. This design is more efficient and superior over those that utilize the back wall and the pivot lug to absorb the force.

In another embodiment of the present invention, the pawl also includes a dust tab extending from the lower end of the pawl. The dust tab is a small protrusion that closes the gap between the lower end of the pawl and the lower end of the opening to prevent dust and debris from entering the cavity of the housing.

BRIEF DESCRIPTION OF THE DRAWINGS

Various details of embodiments of the invention will be described below in association with the accompanying drawings, in which like items are identified by the same reference designation, wherein.

DETAILED DESCRIPTION

Figure 1:
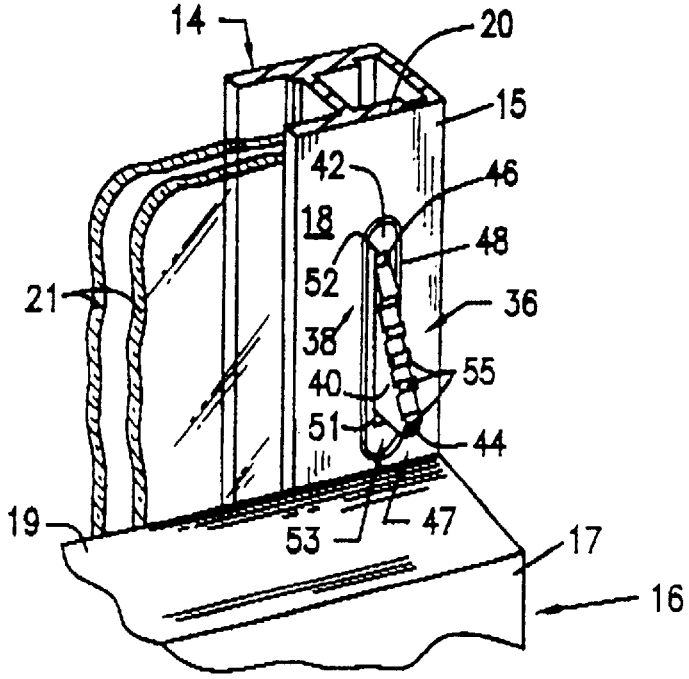
FIG. 1 is a partial perspective view of a portion of a window sash assembly having a window securing device in a securing position embodying the invention installed in an upper window sash frame of the assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
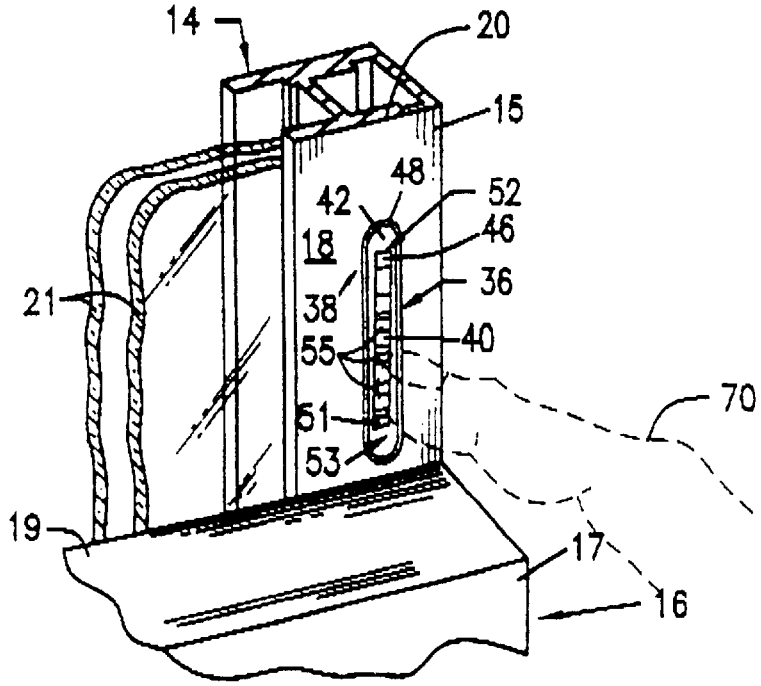
FIG. 2 is a partial perspective view of a portion of the window sash assembly having the window securing device shown in FIG. 1 in a retracted position.

Referring to the drawings, FIGS. 1 and 2 partially illustrate a representative window of a portion of a double-hung window sash assembly. Such an assembly includes a pair of double-hung upper and lower sashes 14 and 16 and fitted with suitable glazing 21, such as shown with upper sash 14. The sashes 14 and 16 are mounted within a main jamb frame (not shown) for vertical slidable movement therein. The construction of the main jamb is not critical for achieving the advantages of the invention so that a description thereof is deemed unnecessary.

Both the frame and sashes 14 and 16 can be formed of different materials, such as metal or strong and rigid plastic materials well known in this field. The sashes 14 and 16 preferably are fabricated from elongated framing members of hollow configuration in cross section. Each sash 14,16 is generally rectilinear in configuration, but for purposes of describing the present invention, only the side member or stile 15 of the upper sash 14 and the upper member or header 17 of the lower sash 16 is relevant. The stile 15 has a front exterior surface 18 and the header 17 has a top exterior surface 19.

The window securing device of the invention is designated generally by the reference character 36 and is shown installed in the stile 15 in FIGS. 1 and 2. The window securing device 36, is especially useful for permitting limited opening of the window sash 16. The exact vertical placement of the securing device 36 in the stile 15 is determined by how much vertical movement of the sash 16 is desired before the header surface 19 is intercepted by the securing device 36. Preferably, two securing devices 36 are installed on the window assembly one in each stile 15 of the upper sash 14 and at the same elevation to gain optimum security.

FIG. 1 illustrates the securing device 36 in a protruded, securing position. A pawl 40 is extended through the opening 51 and fixed in this position to block the pathway of the lower sash 16 as described hereinbelow. When the sash 16 is moved vertically up towards the securing device 36, the top surface 19 of the header 17 engages the bottom surface or arresting edge 47 of the pawl 40, thereby effectively limiting or preventing further movement of the sash 16. This is the general function of the securing device 36.

FIG. 2 illustrates the securing device 36 in a retracted, unsecured position. The user's finger 70 disengages the securing device 36 as described hereinbelow. The pawl 40 is removed from the pathway of the sash as the pawl 40 retracts into the housing 38 (see FIG. 3) securing device 36. In this position, the lower sash 16 is free to move vertically upward beyond the securing device 36 in the stile 15.

Figure 3:
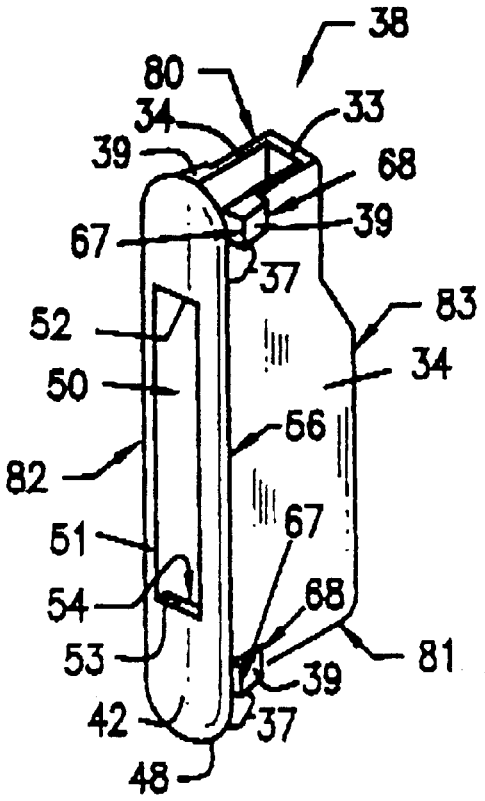
FIG. 3 is a perspective view looking toward the front and right side of a housing without a pawl of the window securing device for an embodiment of the invention.

As shown in FIG. 3, the securing device 36 includes a housing 38 which is configured to be securely retained in an installation opening (not shown) on the front surface 18 of the stile 15. The housing has a top end 80, a bottom end 81, a front portion 82, and a rear portion 83. The housing 38 possesses a unitary construction and may be produced from a range of rigid materials such as extruded or molded plastic polymers, metal, wood, and the like as recognized by one of ordinary skill in the art. One of ordinary skill in the art would certainly recognize that various other forms including different shapes and sizes of housings may be utilized within the spirit and scope of the invention.

The front portion 82 of the housing 38 includes a front wall or faceplate 42 which is designed to overlap the surrounding edge of the installation opening (not shown) in the stile 15 to support the housing 38 therein. The housing 38 further includes opposing side walls 34 and a back wall 33. The top and bottom ends 80 and 81 are open and unbounded.

The faceplate 42 is integral with the housing 38 and projected ever slightly forward of the front surface 18 of the stile 15 so as to not interfere with the relative sliding movement of the sashes 14 and 16. To this end, the faceplate 42 may be provided with a curved outer peripheral edge 48 to improve the outward exterior appearance and aesthetics.

The faceplate 42 includes a centrally located elongate vertical opening 51 which is continuous with an interior cavity 50 of the housing 38. The cavity 50 defined by the opposing side walls 34, faceplate 42, and the back wall 33, is configured to house the pawl 40 therein. The opening 50 of the faceplate 42 includes upper and lower ends 52 and 53. The upper end 52 is adapted to be engageable with the pawl 40 during the securing operation as described hereinbelow. The lower end 53 includes an inner flange 54 on the inside surface of the faceplate 42. The flange 54 is adapted to be engageable with the pawl 40 in the retracted and securing positions as described hereinbelow.

Figure 4:
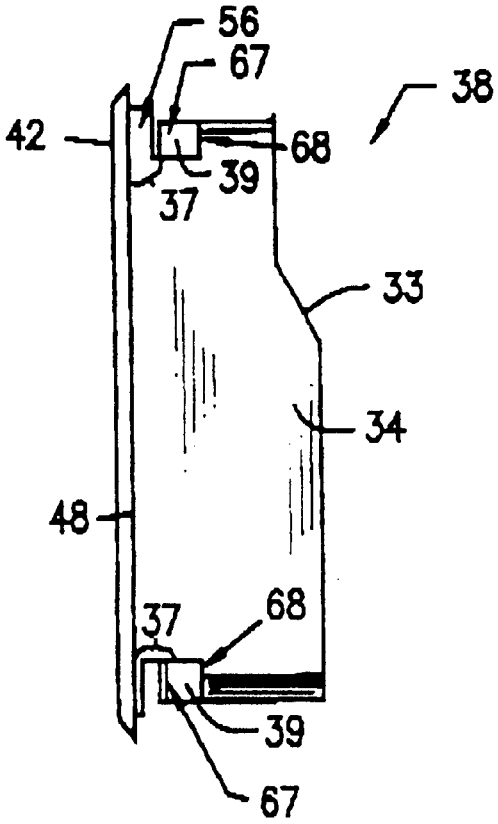
FIG. 4 is a right side elevational view of the housing, the left side elevational view being a mirror image thereof.
Figure 5:
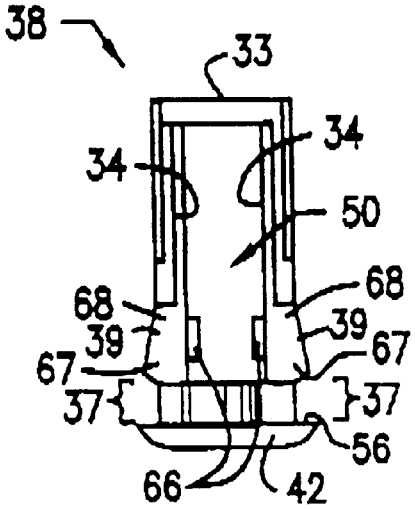
FIG. 5 is a top plan view of the housing.

As shown in FIGS. 3, 4 and 5, flexible anchor tabs 39 extend from the side walls 34 at both ends 80 and 81 of the housing 38 and positioned proximate to the faceplate 42. Each anchor tab 39 is integral at one end 68 with the side wall 34 and includes a free end 67. With use in hollow stiles 15, the anchor tabs 39 are arranged so that they engage edges of the stile surface 18, defining the installation opening (not shown) and exert a slight biasing force thereagainst to secure the housing 38 within the installation opening (not shown). In effect the edges are sandwiched between the tabs 39 and the flange 56 behind the faceplate 42. If the stile 15 is not hollow, the tabs 39 can still retain the housing 38 through frictional contact between the tab 39 and the walls defining the recess in the stile 15.

As best shown in FIG. 5, the housing includes retaining studs 66 extending from the inner opposing side walls 34 within the cavity 50 proximate the top end 80. The studs 66, in combination with mounting recesses 65 (described hereinbelow) of the pawl 40, ensure that the pawl 40 is seated properly within the cavity 50 as it movably transitions between securing and retracted positions as described hereinbelow.

Figure 6:
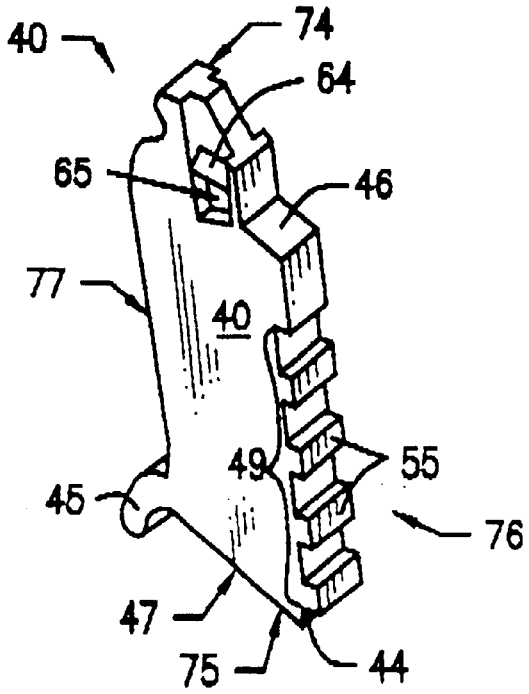
FIG. 6 is a perspective view looking toward the left side of a pawl of the window securing device for one embodiment of the invention.
Figure 7:
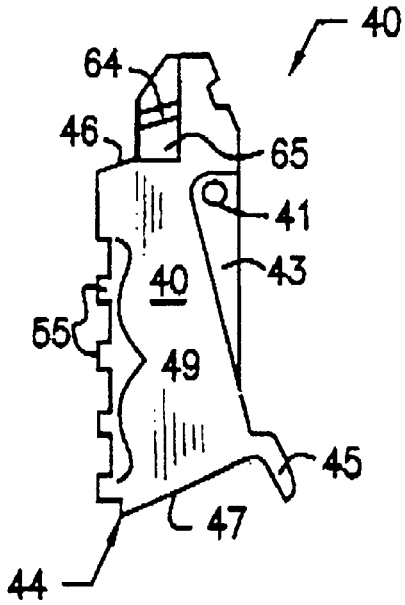
FIG. 7 is a right side elevational view of the pawl of FIG. 6.

FIGS. 6 and 7 illustrate the pawl 40 in the preferred form. However, one of ordinary skill in the art would certainly recognize that various other forms including different shapes and sizes of pawls may be utilized within the spirit and scope of the invention. The pawl 40 is a single unitary piece of material that is operatively connected to the housing 38 and reversibly resides within the cavity 50. The pawl 40 includes an upper end 74, a lower end 75, a front face 76, and a back portion 77. The pawl 40 in the extended position (shown in FIG. 1) is configured to withstand the large vertical force associated with the lifting of the lower sash. 16. The pawl 40 like the housing 38 may be formed from a range of rigid materials such as extruded or molded plastic polymer, metal, wood, and the like as recognized by one of ordinary skill in the art.

As shown in FIGS. 6 and 7, the pawl 40 includes stud mounting recesses 65 on the opposing sides thereof and proximate to the upper end 74 of the pawl 40. The recesses 65 are configured to receive the retaining studs 66 extending from the inner side walls 34 of the housing 38. A ridge 64 bounds the top of each recess 65. The ridge 64 is configured to keep the stud 66 within the recess 65, thereby ensuring the proper positioning of the pawl 40 within the cavity 50.

Figure 10:
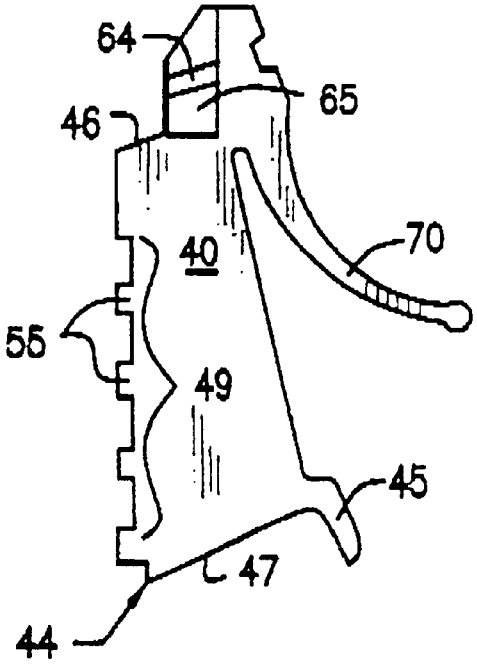
FIG. 10 is a right side elevational view of an alternative embodiment of a pawl including an integral spring element.
Figure 8:
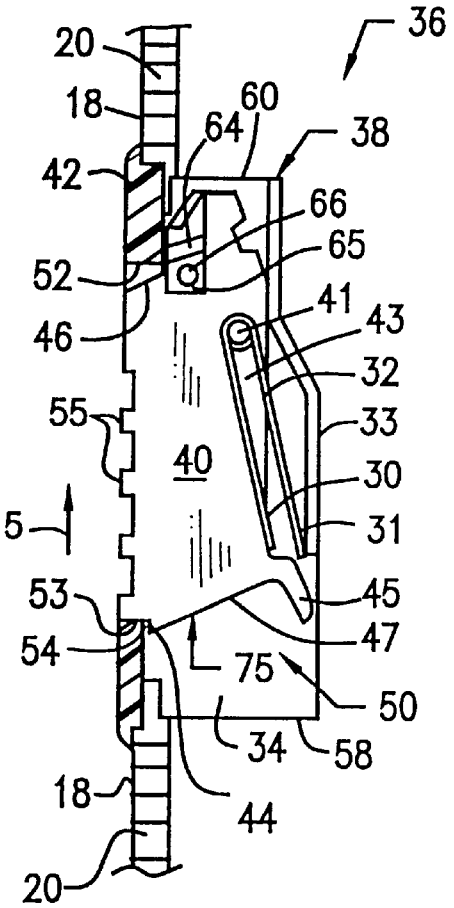
FIG. 8 is a longitudinal cross-sectional view of the housing of the window securing device showing an associated pawl in its retracted position in one embodiment of the invention.
Figure 9:
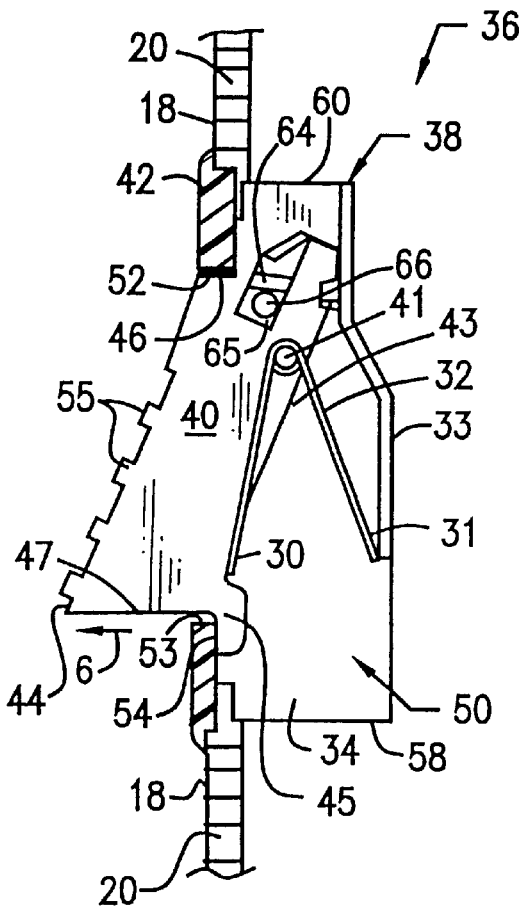
FIG. 9 is a longitudinal cross-sectional view of the housing of the window securing device showing the pawl of FIG. 8 in its securing or extended non-retracted position.

As shown in FIG. 7, the pawl 40 includes a recessed area 43 on its back portion 77, and is configured to receive a torsional spring 32 (shown in FIGS. 8 and 9). A truncated pin 41 serves as the mounting structure for the torsional spring 32 within the recessed area 43 in the pawl 40. The torsional spring 32 functions to normally bias the pawl 40 forward into the securing position. Variations of the spring 32 shown may also be suitable, including a leaf spring, coil spring, integral flexing member or other device for biasing the pawl 40. As shown best in FIG. 10, an alternative embodiment of the pawl 40 utilizes an integral spring element 70. The integral spring element 70 is fabricated together with the pawl 40 during the plastic polymer extrusion or molding process.

As the torsional spring 32 biases the pawl 40 into the securing position, a retaining lip 44 on the lower end of the front face 76 is configured to retain the pawl 40 in the retracted position within the cavity 50. The lip 44 is adapted to be engageable with the inner flange 54 proximate the lower end 53 of the opening 51 as described hereinbelow.

Along the lower end 75 (see FIG. 6) of the pawl 40, an arresting edge 47 provides a surface engageable with the top surface 19 of the header 17 of the lower sash 16. In the securing position, the edge 47 lies parallel to the surface 19 of the header 17 (as shown in FIG. 1). The pawl 40 further includes a contact edge 46 proximate the upper end 74 on the front face 76. In the securing position, the contact edge 46 abuts flat against the upper end 52 of the opening 51 in the housing 38. The contact edge 46 in conjunction with the upper end 52 serves to transfer the vertical force originating from the arresting surface 47 in engagement with the lower sash 16 into the stile wall 20 above the device 36.

A dust tab 45 extends from the back portion 77 of the pawl 40 proximate the lower end 75, and is configured to engage with the inner flange 54 proximate the lower end 53 of the opening 51. The tab 45 engages the flange 54 when the pawl 40 is in the securing position and serves to keep dirt or debris out of the cavity 50 that could enter the spacing between the lower end 75 of the pawl 40 and the lower end 53 of the opening 51.

A gripping surface 49 is included along the front face 76 of the pawl 40 and is configured to be engageable with a user's finger 70. The gripping surface 49 may include a plurality of spaced apart ridges 55 along the face 76 which is adapted to be readily gripped by the user's finger 70 (shown in FIG. 2) so that the necessary force can be applied to urge the securing device 36 into the securing or retracted positions. One or more ridges 55 may be provided, with four ridges 55 to engage the user's finger 70 being a preferred design.

Referring to FIGS. 8 and 9, the securing device 36 is shown in greater detail. For ease of assembly, the housing 38 is formed of a unitary body. The pawl 40 with the torsional spring 32 mounted on the truncated pin 41, is placed in the cavity 50 through the opening 58 at the bottom end 81 of the housing 38. The upper end 74 of the pawl 40 enters first and continues on until the studs 66 become seated within the recess 65 on each side. The retaining ridge 64 is configured so that the top edge has a slight downward slope to allow the studs 66 to slip by with ease, but the undersurface thereof is flat to prevent the studs 66 from reversibly sliding out the recess 65. Utilizing the above simple and minimal number of steps, the assembly of the securing device 36 is complete. With the simple design of the present invention, the advantages in manufacturing become apparent.

In operation, the pawl 40 of the securing device 36 is normally in the retracted position shown in FIG. 8. The torsional spring 32 biases the retaining lip 44 against the inner flange 54 to retain the pawl 40 inside the housing 38. The retaining studs 66 are seated in the associated stud mounting recesses 65 and in combination allow for swiveling action as the pawl 40 goes from a retracted to securing position. To limit the upward movement of the lower sash 16, the user slides the pawl 40 vertically upward 5 along the front face 76, with the aid of the ridges 55 on the gripping surface 49, until the retaining lip 44 clears the inner flange 54.

Referring specifically to FIG. 9, once the lip 44 clears the inner flange 54, the torsional spring 32 then moves the lower end 75 of the pawl 40 in the direction 6. The arresting edge 47 is then positioned above and parallel to the top surface 19 of the header 17 of the lower sash 16 (as shown in FIG. 1). The contact edge 46 abuts with the upper end 52 of the opening 51. The dust tab 45 engages with the inner flange 54 to cover the gap forming between the arresting surface 47 and the lower end 53 of the opening 51. The tab 45 effectively prevents dust or debris from entering the cavity 50.

When the arresting surface 47 engages the surface 19 of the header 17 of the lower sash 16 (i.e. when the lower sash is lifted), the contact edge 46 and the upper end 52 of the opening 51, prevents over-rotation of the pawl 40 to limit movement of the lower sash 16. The associated vertical force is absorbed into the stile wall 20 above the securing device 36. Little or no force is exerted on the retaining studs 66. No surface of the pawl 40 is adapted to engage housing 38 for resisting over-rotation except for the contact edge 46.

The securing device 36 is returned to the retracted position by disengaging the lower sash 16 from the arresting edge 47 and pushing the pawl 40 into the housing 38 until the face 76 is flush with the faceplate 42. Next the pawl 40 is slid downward with the aid of the gripping surface 49 until the retaining lip 44 engages behind the inner flange 54.

While the specific embodiments have been illustrated and described, numerous modifications come to mind without significantly departing from the spirit of the invention and the scope of protection is only limited by the scope of the accompanying Claims.

We claim:

1. A window securing device for use in a double-hung sash window assembly having upper and lower sash window frames installed for relative overlapping vertical sliding movement, said upper sash frame having a recess into the interior of a vertical facial member thereof, said device comprising;

a housing including a front faceplate opening into a cavity in said housing, and means adapted for retaining said housing in said recess with said faceplate surrounding the perimeter edges of said recess;

a pawl having upper and lower ends and front and back surfaces;

means for pivotally mounting said pawl within the cavity of said housing;

spring biasing means mounted on said pawl within said housing for normally biasing a lowermost arresting edge at said lower end of said pawl, away from said housing and adapted to be into the pathway of a top portion of said lower sash for preventing further opening thereof or upper movement, said pawl being in a securing position with an uppermost contact edge at said upper end of said pawl configured for abutting against an inside edge of the top of the opening in said faceplate, and adapted for transferring a substantial portion of the upward force of said lower sash through said pawl and housing into said upper sash frame; and a tab extending from said back surface of said pawl and being configured for engagement with an inside edge of the bottom of said opening in said faceplate, for keeping dust or debris out of said cavity when said pawl is in the securing position.

2. The device of claim 1, wherein said mounting means includes:

a pair of stud mounting recesses on opposing sides, respectively, of said pawl proximate its upper end;

a pair of retaining studs, each extending into said cavity from opposing inside surfaces of the housing; and each retaining stud being nested within an associated stud mounting recess for pivotally mounting said pawl within said cavity.

3. The device of claim 2, further including means for selectively retaining said arresting edge of said pawl within said cavity, said pawl being in a retracted position for permitting further opening of said lower sash.

4. The device of claim 3, wherein said means for retaining said arresting edge within said cavity includes:

a protruding lip at said lower end of said pawl proximate its front surface, being configured to engage an inside edge of the bottom of the opening in said faceplate; and said pair of stud mounting recesses being configured for permitting said pawl to slide on said retaining studs to selectively move its protruding lip onto the inside edge of said faceplate.

5. The device of claim 1, wherein said pawl further includes a gripping surface on said front surface thereon.

6. The device of claim 5, wherein said gripping surface includes a plurality of ridges along said front surface.

7. The device of claim 1, wherein said means for retaining said housing in said recess includes two pair of anchor tabs, each pair extending from upper and lower ends of side portions of said housing for snapping said housing into the recess of said vertical facial member, whereby said anchor tabs secure the edge of said recess against the edge of said faceplate.

8. The device of claim 1, wherein said spring biasing means is a torsional spring.

9. The device of claim 8, further including:

said torsional spring having first and second ends;

said first end being biased against said pawl; and said second end being biased against an inside back wall of said housing.

10. The device of claim 1, wherein said housing is composed of a unitary construction.

11. A window securing device for use in a double-hung sash window assembly having upper and lower sash window frames installed for vertical reciprocal sliding movement, one relative to the other, said upper sash frame having a recess into the interior of an inside face of a vertical member thereof, said device comprising:

a housing including:

(a) a cavity formed by opposing side walls and a back wall;

(b) a faceplate overlaying said cavity having an opening into the cavity; and (c) said housing adapted to be retained in said recess with the faceplate surrounding the perimetric edges of said recess;

a pawl having front and back surfaces and upper and lower ends with said upper end including means to mount said pawl in the housing, said lower end being movable between a securing position and a retracted position in the opening of the faceplate;

a tab at said lower end of the pawl protruding outwardly from the back surface and configured for engagement with the lower end of the opening of the faceplate during movement of the pawl into said securing position, such that whenever said pawl is in the securing position, said tab function to keep any dust or debris out of the cavity;

a spring being mounted on said pawl for biasing the lower end of said pawl to protrude out of said opening into said securing position wherein the pawl is adapted to engage against the lower sash frame and prevent such relative sliding movement between the sash frames;

said spring mounted pawl being retractable manually into the cavity and adapted to disengage said lower end of the pawl from the lower sash frame and permit such relative sliding movement between the sash frames;

means for releasably retaining said lower end of the pawl in said retracted position within said cavity; and said upper end of the pawl having a contact edge configured for engagement with the top of the opening in the faceplate whenever said pawl is in said securing position, said pawl in the securing position has its lower end adapted to protrude over the top edge of the lower sash frame to prevent the lower sash frame from being raised upward, whereby if an attempt is made to raise said lower sash a vertically directed contact is imposed therefrom to the lower end of said pawl, thereby causing a vertical component force to be directed upward from said contact edge of said pawl into the upper edge of the opening of the faceplate, such that said pawl resists further upward movement of said lower sash, and adapted to transfer the resultant force vector into a stile of said upper sash frame.

12. The device of claim 11, wherein said spring is integral with said pawl.

13. The device of claim 11, wherein said housing is composed of a unitary construction.

14. The device of claim 11, wherein said pawl and said housing are made of a rigid plastic polymer composite.

15. The device of claim 11, wherein said pawl mounting means includes:

a pair of stud mounting recesses on opposing sides, respectively, of said pawl, proximate its upper end;

a pair of retaining studs, each extending from opposing inside surfaces of said side wall portions of the housing; and each retaining stud being nested within an associated stud mounting recess for pivotally mounting said pawl within said cavity.

16. The device of claim 15, wherein the stud mounting recesses are elongated for permitting said pawl to be slid within said housing for causing a protruding lip at the lower end of the front surface of the pawl to engage an inside portion of the lower end of said opening.

17. The device of claim 11, further including a means for securably retaining said housing within the recess of the sash frame.

18. The device of claim 17, wherein said means includes a pair of anchor tabs at the top and at the bottom end of said housing configured to exert slight biasing force against the perimetric edges of said recess.

19. The device of claim 11, wherein said pawl includes a gripping surface along the front surface thereof for user's fingers.

20. The device of claim 19, wherein said gripping surface includes a plurality of sawtooth ridges defined along the front surface of the pawl.

21. The device of claim 11, wherein said spring is a torsional spring.

22. The device of claim 21, wherein:

said pawl further includes a recessed portion proximate said back surface;

said torsional spring having first and second ends; and said first end being within said recessed portion, and said second end being retained against an inside surface of said back wall.

23. A window securing device for use in a double-hung sash window assembly having upper and lower sash window frames installed for relative overlapping vertical sliding movement, said upper sash frame having a recess into the interior of a vertical facial member thereof, said device comprising:

a housing having an opening in communication with a cavity in the housing, the opening defining an inside edge of the housing, the housing being adapted to be supported in the recess;

a pawl having an upper end having a contact edge, the pawl further having a lower end and a front surface and a back surface, the pawl being pivotally supported within the cavity;

a spring mounted on the pawl within the housing, the spring normally biasing a lowermost arresting edge at said lower end of the pawl, away from the housing and adapted to be into the pathway of a top portion of the lower sash to define a securing position wherein the contact edge is configured for abutting against the inside edge and adapted to transfer a portion of the upward force of said lower sash through the pawl and housing and into the upper sash frame and;

a tab at said lower end of the pawl protruding outwardly from the back surface and configured for engagement with a lower end of the opening of the face plate during movement of the pawl into said securing position, such that whenever said pawl is in the securing position, said tab functions to keep any dust or debris out of the cavity.

* * * * *

UNITED STATES PATENT AND TRADEMARK OFFICE

CERTIFICATE OF CORRECTION

PATENT NO. : 6,364,375 B1 
DATED : April 2, 2002
INVENTOR(S) : Matthew Peter Szapucki and Richard J. Kulkaski It is certified that error appears in the above-identified patent and that said Letters Patent is hereby corrected as shown below:

Title page,
Item [56], References Cited, delete "Taliaferrro" and insert therefor -- Taliaferro --

Column 5,
Line 19, delete "sash. 16." and insert therefore -- sash 16. --

Column 7,
Line 14, delete "comprising;" and insert therefore -- comprising: --

Column 8,
Line 42, delete "function" and insert therefore -- functions --

Signed and Sealed this

Twenty-seventh Day of August, 2002

*Attest:*

*Attesting Officer*

JAMES E. ROGAN
*Director of the United States Patent and Trademark Office*